US006227309B1

(12) United States Patent
Henke et al.

(10) Patent No.: US 6,227,309 B1
(45) **Date of Patent: *May 8, 2001**

(54) ROTARY HAMMER

(75) Inventors: Andreas Werner Henke, Bad Camberg; Martin Lauterwald, Huenstaetten-Goersroth; Bruno Meinholf Ruethers, Bad Camberg; Thomas Michael Stanke, Idstein, all of (DE)

(73) Assignee: Black & Decker Inc., Newark, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/501,526

(22) Filed: Feb. 9, 2000

(30) Foreign Application Priority Data

Feb. 9, 1999 (GB) ..... 9902789

(51) Int. Cl.[7] ..... B25D 11/04
(52) U.S. Cl. ..... 173/201; 173/109; 173/212
(58) Field of Search ..... 173/109, 104, 173/48, 210, 212, 201

(56) References Cited

U.S. PATENT DOCUMENTS

| | | | | |
|---|---|---|---|---|
| 3,067,584 | | 12/1962 | Atkinson . | |
| 3,203,490 | | 8/1965 | McCarty et al. . | |
| 4,442,906 | * | 4/1984 | Simpson | 173/48 |
| 4,567,951 | * | 2/1986 | Fehrle et al. | 173/201 |
| 4,602,689 | | 7/1986 | Wanner . | |
| 5,111,890 | * | 5/1992 | Ranger et al. | 173/104 |
| 5,435,397 | * | 7/1995 | Demuth | 173/201 |
| 5,775,440 | * | 7/1998 | Shinma | 173/109 |
| 5,873,418 | * | 2/1999 | Arakawa et al. | 173/201 |
| 5,975,217 | * | 11/1999 | Frenzel et al. | 173/201 |

FOREIGN PATENT DOCUMENTS 0564217 10/1993 (EP) .

* cited by examiner

*Primary Examiner*—Scott A. Smith
(74) *Attorney, Agent, or Firm*—Michael P. Leary; Bruce S. Shapiro

(57) ABSTRACT

A rotary hammer which comprises a tool holder (2), an air cushion hammering mechanism which comprises a piston (9) and a beat piece (21) slideably located in a cylinder (8') so that reciprocation of the piston in the cylinder will cause the beat piece to hit a tool located in the tool holder; and means for causing the cylinder to rotate in addition to, or instead of, reciprocation of the piston in order to cause a tool located in the tool holder to rotate. The piston (9) is formed from a plastics material and is sealed in the cylinder (8') by an annular seal (27) that is located within an annular groove (26) in the piston. The annular seal has an inner diameter that is greater than the diameter of the radially outwardly directed surface of the groove, and the groove has an axial dimension that is greater than that of the annular seal, so that when the cylinder rotates about the piston (without reciprocation of the piston) the seal (26) will rotate with the cylinder (8').

8 Claims, 2 Drawing Sheets

ROTARY HAMMER

BACKGROUND OF INVENTION

This invention relates to rotary hammers, and, in particular to hammers that incorporate an air cushion hammering mechanism.

Such hammers will normally include a tool holder that can hold a hammer bit or chisel bit for acting on a workpiece, and an air cushion hammering mechanism which comprises a piston and a beat piece that are slidably located in a cylinder so that reciprocation of the piston in the cylinder will cause the beat piece to hit a bit located in the tool holder. Such hammers may, however, be employed in more than one mode. For example a hammer may be capable of being employed in a hammer only or so-called "chiselling" mode in which the piston reciprocates within the cylinder in order to cause the beat piece to hit the bit without any rotation of the tool, or alternatively a drilling only mode in which the cylinder may form part of a spindle connected to the tool holder and is caused to rotate about the piston, thereby causing the bit inserted in the tool holder to rotate. The hammer may also be capable of being employed in a combination rotary hammer mode in which the piston reciprocates within the cylinder causing the beat piece to hit the bit while at the same time the cylinder rotates about the axis of the piston, thereby causing the bit to rotate.

As an example, one such hammer is described in WO 98/47670. This hammer has a drive motor that is arranged with its armature shaft at right angles to the axis of the hammer spindle, and has a single switching mechanism that can switch the hammer between pure rotation, pure chiselling and combination rotation and chiselling modes. The armature shaft of an electric motor is coupled to a drive shaft on which is mounted one end of a crank arm that causes the piston to reciprocate within a horizontally oriented cylinder when the drive shaft rotates. The piston is linked to a ram also located in the cylinder by means of an air gap so that reciprocation of the piston causes the ram to reciprocate and to hit a beat piece located forward of the ram, thereby causing the beat piece to impact the rear end of the bit that is inserted in the tool holder. The mode of operation may be changed by means of a switch into a rotary mode in which the piston crank is decoupled from the drive shaft, and instead the cylinder is caused to rotate about the piston, ram and beat piece, thereby causing the bit to rotate in the tool holder. By moving the switch to a third position, the piston can be caused to reciprocate while the cylinder rotates, thereby putting the bit into rotary hammering or chiselling mode.

The cost of such a hammer and also the vibration caused by the reciprocating parts could be reduced if they were formed from a plastics material instead of metal. However, forming the piston from such a material will cause problems with regard to heat generation in the piston during operation, due to the much lower thermal conductivity of plastics materials than that of metals.

SUMMARY OF INVENTION

The present invention is characterised in that the piston is formed from a plastics material and is sealed in the cylinder by means of an annular seal that is located within an annular groove in the piston, the annular seal having an inner diameter that is greater than the diameter of the radially outwardly directed surface of the groove, and the groove having an axial dimension that is greater than that of the annular seal, so that when the cylinder rotates about the piston (without reciprocation of the piston) the seal will rotate with the cylinder.

We have found that if a conventionally sealed piston were replaced with one that is formed from a plastics material it would operate quite satisfactorily in pure chiselling mode in which the piston reciprocates in the cylinder without rotation of the cylinder, but when the hammer is operated in rotational mode, friction between the seal in the piston and the surfaces of the cylinder and the surfaces of the locating groove in the piston causes undue temperature rises in the seal and/or the piston and degradation thereof, this temperature rise being caused at least partly by the fact that the plastics material of the piston will have a much lower heat conductivity that of the metals that have hitherto been used. In accordance with the present invention, however, the seal is in the form of a "floating" seal. This seal is not in contact with the bottom of the groove in the piston, and, even if it is in contact with the side walls of the piston groove during pure rotational mode, does not impart a force against the piston groove walls. Thus, in pure rotational mode, the seal will rotate with the cylinder but will not generate significant frictional heat in the piston. When the hammer is used in chiselling mode, in which the piston reciprocates but the cylinder does not rotate, any frictional heating will be generated between the seal and the metallic cylinder, and will be dissipated by the cylinder.

Preferably the axial dimension of the groove is up to 0.5mm greater than that of the seal, and more preferably from 0.1 to 0.3mm greater than that of the seal. The outer diameter of the seal should be greater than that of the piston, but preferably by no more than 1 mm in order to reduce deformation of the seal.

The hammer may be one that is capable, as mentioned above, of operating in combination rotary hammer mode in which the cylinder rotates about the piston while at the same time the piston reciprocates within the cylinder. In this case, the annular seal is preferably arranged so that it will rotate about the piston but at a slower rate than the cylinder. This may be achieved simply by the appropriate size of the seal with respect to the piston. In this case, some heating of the piston will occur due to friction between the seal and the side walls of the piston groove, but this will be limited because the speed of the seal with respect to the piston groove walls is reduced, and because the seal will alternately engage opposite sides of the groove as the direction of reciprocation of the piston alternates.

BRIEF DESCRIPTION OF DRAWINGS

One form of rotary hammer according to the present invention will now be described by way of example with reference to the accompanying drawings in which.

DETAILED DESCRIPTION OF INVENTION

Figure 1:
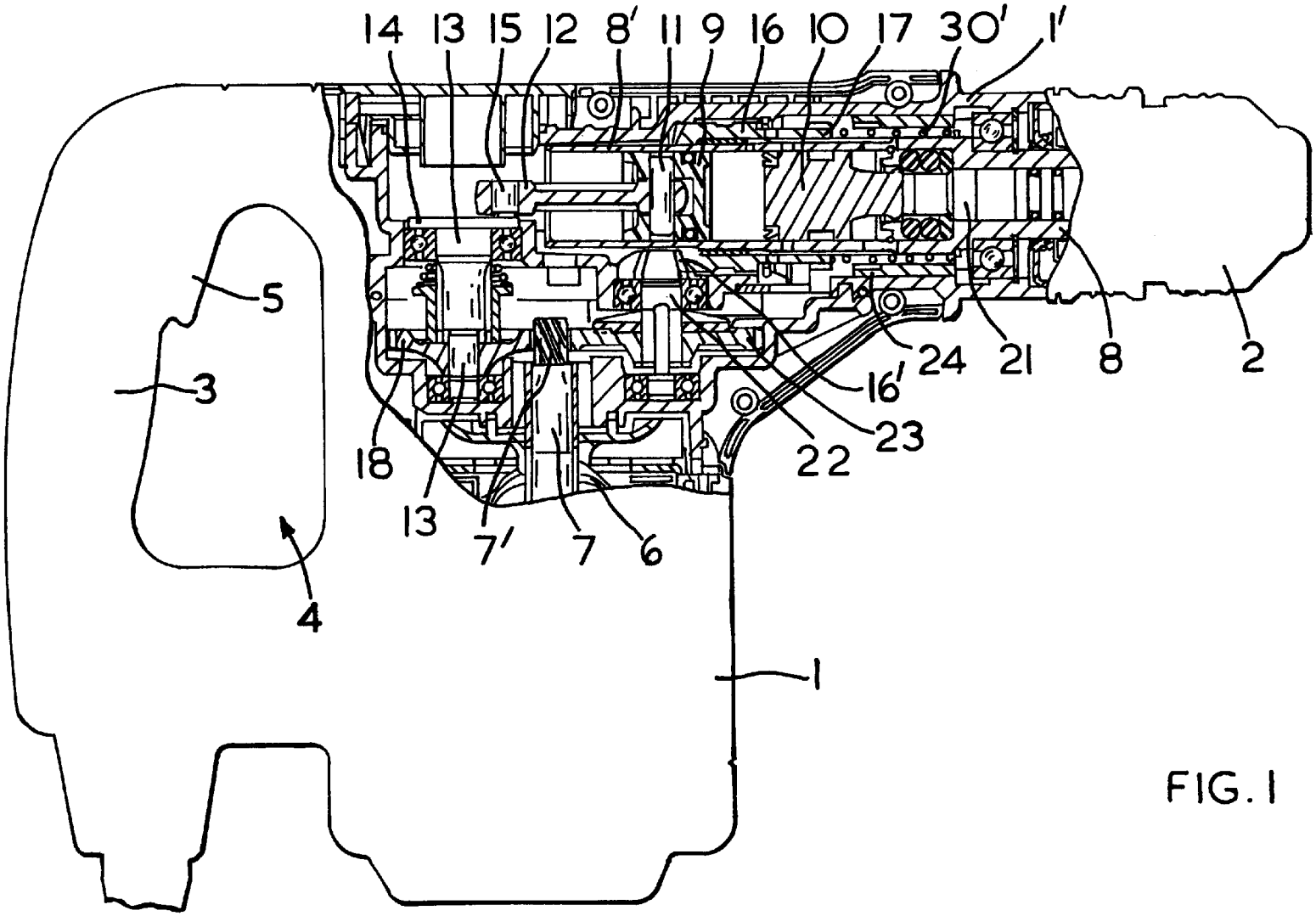
FIG. 1 shows, partly broken open and in section, a rotary hammer.

Referring to the accompanying drawings, a rotary hammer, described in more detail in WO 98/47670, and in U.S. application Ser. No. 09/060,395, the disclosure of which is incorporated herein by reference, has a hammer housing 1, made up in the usual way of several components, which forms a gripping portion 3 at its rear end, so that a customary switch actuator 5 for switching the electric motor 6 on and off projects into a grip opening 4 which is defined at its rear side by the gripping portion 3. In the rear lower portion of the hammer housing 1, a mains lead which serves to connect the rotary hammer to a power source, is led out.

Located in the upper portion of the rotary hammer in FIG. 1 is an inner housing 1', formed of half-shells and made from cast aluminium or the like, which extends forwards out of the rotary hammer housing 1 and in which the hammer spindle 8 is rotatably housed. The rear end of the latter forms the guide tube or cylinder 8', provided in known manner with vent apertures, for a pneumatic or air cushion hammer mechanism, and at the front end of which the customary tool holder 2 is held. The hammer mechanism contains a piston 9 formed from an engineering plastics material such as nylon 4,6 or nylon 6,6 which may contain a small quantity of polytetrafluoroethylene in order to aid sliding within the cylinder. The piston 9 is coupled, via a trunnion 11 housed in it and a crank arm 12, with a crank pin 15 which sits eccentrically on the upper plate-shaped end 14 of a drive shaft 13. A reciprocating movement of the piston 9 is carried out to alternately create a vacuum and an over-pressure in front of it, in order to move the ram 10 situated in the cylinder 8' correspondingly, so that this transmits impacts onto the beat piece 21, which passes them on to the rear end of a hammer bit or chisel bit, not represented, which is inserted into the tool holder 2. This mode of operation and the structure of a pneumatic or air cushion hammer mechanism are, as already mentioned, known per se.

The electric motor 6 is arranged in the hammer housing 1 in such a way that its armature shaft 7 extends perpendicularly to the longitudinal axis of the hammer spindle 8 and the tool holder 2, the longitudinal axis of the armature shaft 7 preferably lying in a plane with the longitudinal axis of the hammer spindle 8 and tool holder 2. At the upper end of the armature shaft 7 in FIG. 1 a pinion 7' is formed which meshes with a gear wheel 18 which sits rotatably on the drive shaft 13 for the hammer mechanism. The pinion 7' also meshes with a gear wheel 23 which is arranged on the side of the armature shaft 7 lying opposite the drive shaft 13 and is non-rotatably secured on a shaft 22 rotatably housed in the housing 1'. At the upper end of the shaft 22 a bevel gear is formed, which meshes with the bevel toothing 16' of a drive sleeve 16 which sits rotatably via a schematically indicated friction bearing, but axially non-displaceably on the hammer spindle 8 or on its rear part forming the guide tube 8' for the hammer mechanism. A coupling sleeve 17 is arranged, axially displaceable but non-rotatable as a result of engagement with a splined section on the outer surface of the hammer spindle 8, on the hammer spindle 8 in front of the drive sleeve 16. This coupling sleeve 17 can be displaced between a position in which it is in positive engagement, via teeth or projections formed at its rear end, with corresponding teeth or projections at the front end of the drive sleeve 16, and a forwardly displaced position in which there is no engagement between it and the drive sleeve 16. A helical spring 30' loads the coupling sleeve 17 in the direction of the drive sleeve 16. The result of this spring loading is that, upon movement of the coupling sleeve 17 in the direction of the positive engagement with the drive sleeve 16 and a concomitant blocking of the positive engagement by abutment of the end faces of the projections or teeth of the coupling sleeve 17 against the end face of the projections or teeth of the drive sleeve 16, a positive engagement is then automatically established when there is a relative twisting of the coupling sleeve 17 and the drive sleeve 16, say because the shaft 22 rotates the drive sleeve 16.

As can be seen, a rotation of the armature shaft 7 via the gear wheel 23 and the bevel toothing of the shaft 22 causes a rotation of the drive sleeve 16 and, when there is a positive engagement between this and the coupling sleeve 17, also a rotation of the hammer spindle 8 and thus of the tool holder 2. Accordingly, in the absence of a positive engagement between the drive sleeve 16 and the coupling sleeve 17, the hammer spindle 8 is not rotated despite rotation of the drive sleeve 16. If, rather, the coupling sleeve 17 with its protrusions which are provided at the front end-area and project radially outwards enter into a positive engagement with corresponding recesses in the housing-fixed zone 24, the result is a position of the coupling sleeve 17, and thus of the hammer spindle 8 including the tool holder 2, which is locked against rotation. This mode of operation of the coupling sleeve 17 is known.

To drive the hammer mechanism, the gear wheel 18 driven by the pinion 7' of the armature shaft 7 is coupled with the drive shaft 13 in a manner described in detail in WO98/47670, so that the crank pin 15 performs a circular movement which creates, via the crank arm 12, the reciprocating movement of the piston 9 in the guide tube 8' of the hammer mechanism. This type of drive is also known in rotary hammers in which the armature shaft 7 of the drive motor 6 lies perpendicular to the longitudinal axis of the hammer spindle 8 and the tool holder 2.

To switch between the individual operating modes of the rotary hammer, the hammer has a single switching element (not shown) which acts as described in WO 98/47670.

Figure 2:
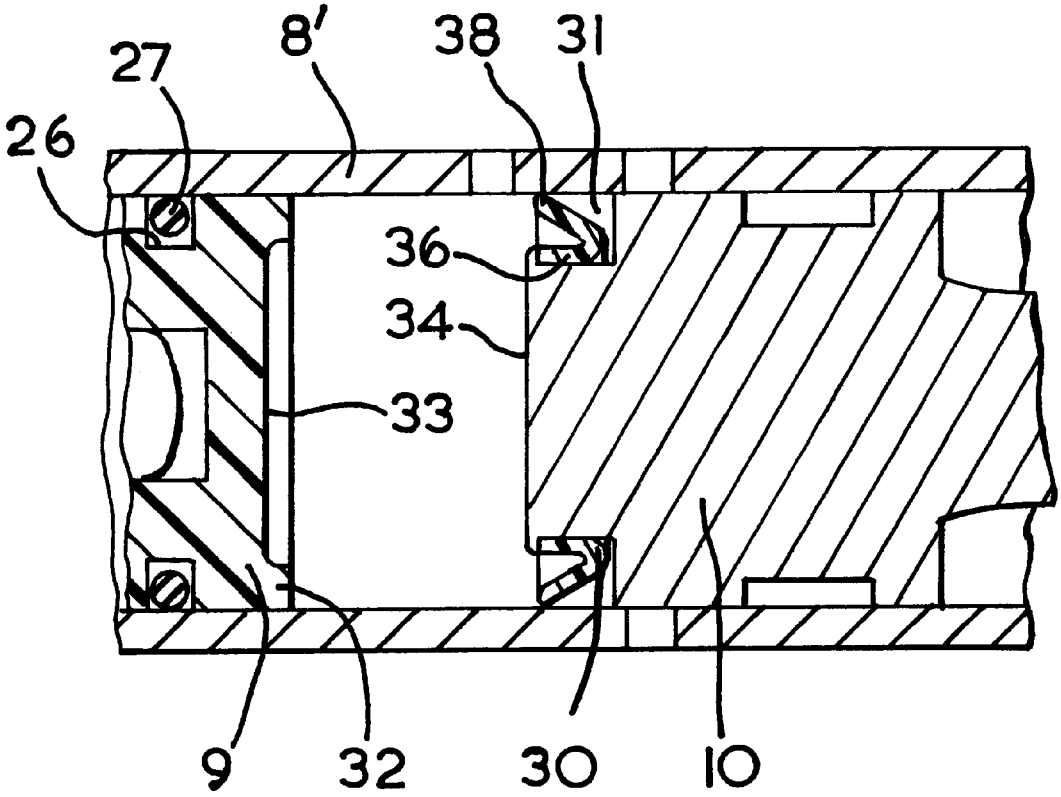
FIG. 2 shows part of the hammer of FIG. 1 in greater detail.

The piston 9 is shown in more detail in FIG. 2 and is provided with a peripheral groove 26 in which is located an annular seal 27 in the form of an O-ring made from a relatively temperature-resistant elastomer such as that sold by DuPont under the tradename "Viton". The seal 27 has, in its unstrained state, an inner diameter that is about 0.5 mm greater than the diameter of the base of the groove, and an outer diameter that is also about 0.5 mm greater than the diameter of the piston. The groove 26 has an axial dimension that is about 0.1 to 0.3 mm greater than that of the seal 27. The difference in dimensions between the seal 27 and the groove 26 is exaggerated in FIG. 2. These dimensions cause the seal to rotate about the piston 9 when the hammer is operated in drilling only mode without frictional heating of the seal against the groove walls. When the hammer is operated in chiselling mode in which the piston 9 reciprocates within the cylinder without rotation of the cylinder, the seal will provide a satisfactory seal against the over and under-pressure of the air in the gap between the piston 9 and the ram 10 but will not cause any frictional heating within the piston 9 because there will be no rotational movement between the seal 27 and the piston 9. The seal 27 is approximately 0.5 mm oversize, that is to say approximately of 0.5 mm greater outer diameter than the piston in order to provide a seal when the direction of movement of the piston changes each cycle. When the hammer is operated in combined rotary hammer mode in which the piston 9 reciprocates within the cylinder 8' and the cylinder rotates about the piston, the seal 27 will rotate about the piston but at a lower speed than the cylinder, and so generating less heat within the piston.

As is shown in more detail in FIG. 2, in order to provide a seal between the ram and the internal surface of the cylinder 8' with reduced friction, the ram 10 is provided with a seal 30 located in a recess 31 at the rear end thereof. The seal 30 is generally annular in shape and the annulus has a substantially "L" shaped cross-section, i.e. having a generally cylindrical annular part 36 that can be positioned against the circumferential surface of the recess, and a second, generally frusto-conical annular part 38 that is flexibly joined thereto at the front edge (in the direction of use of the hammer) so that it extends between the ram 10 and the cylinder 8' at an acute angle to the surface of the ram in order to seal the two against an overpressure in the region between the piston 9 and the ram 10 (hereinafter referred to as an "L"-ring seal). The seal is formed from a relatively resiliently undeformable material (in this case polytetrafluoroethylene) so that it cannot be located in a groove in the ram but must be slipped over the rear end of the ram into the recess. The recess may be provided with a small raised ridge 40 at its rearward end in order to prevent the seal 30 slipping off the ram 10. In view of the presence of the recess 31 and the "L"-shaped cross-sectioned seal 30, the rear surface of the ram is not planar. In view of this, the forwardly directed face of the piston 9 is provided with a forwardly directed ridge 32 extending around its peripheral region so that the forward face 33 of the piston generally complements the shape of the rearwardly directed end face 34 of the ram 10. The complementary shape of the faces 33 of the piston and 34 of the ram enables the volume of the air gap between the piston 9 and the ram 10 to be minimised, and the air pressure to be maximised, at the point of closest approach of the piston to the ram. This enables the greatest impulse to be transferred from the piston 9 to the ram 10 by the air cushion without the piston and the ram touching one another.

What is claimed is:

1. A rotary hammer which comprises:

(a) a tool holder;

(b) an air cushion hammering mechanism which comprises a piston and a beat piece slidably located in a cylinder so that reciprocation of the piston in the cylinder will cause the beat piece to hit a tool located in the tool holder; and (c) means for causing the cylinder to rotate in addition to, or instead of, reciprocation of the piston in order to cause a tool located in the tool holder to rotate;

wherein the piston is formed from a plastics material and is sealed in the cylinder by means of an annular seal that is located within an annular groove in the piston, the annular seal having an inner diameter that is greater than the diameter of the radially outwardly directed surface of the groove, and the groove having an axial dimension that is greater than that of the annular seal, so that when the cylinder rotates about the piston (without reciprocation of the piston) the seal will rotate with the cylinder.

2. A hammer as claimed in claim 1, wherein the axial dimension of the groove is up to 0.5 mm greater than that of the seal.

3. A hammer as claimed in claim 1, wherein the axial dimension of the groove is in the range of from 0.1 to 0.3 mm greater than that of the seal.

4. A hammer as claimed in claim 1, wherein the outer diameter of the annular seal is greater than that of the piston.

5. A hammer as claimed in claim 1, wherein the outer diameter of the annular seal is greater than the diameter of the piston by no more than 1 mm.

6. A hammer as claimed in claim 1, wherein, when the cylinder rotates about the piston and the piston reciprocates within the cylinder, the annular seal will rotate about the piston but at a slower rate than the cylinder.

7. A hammer as claimed in claim 1, which includes a ram located in the cylinder between the piston and the beat piece, the ram having an annular recess in the end thereof nearest the piston, which recess accommodates an annular seal, and the piston has a face that is oriented toward the ram and which has a shape that complements the profile of the end of the ram that is directed toward the piston.

8. A hammer as claimed in claim 1, which includes a ram located in the cylinder between the piston and the beat piece, the ram having an annular recess in the end thereof nearest the piston, which recess accommodates an annular seal, and the piston has a face that is oriented toward the ram and which has a shape that complements the profile of the end of the ram that is directed toward the piston and the annular seal on the ram has a substantially "L"-shaped cross-section having one part that extends between the ram and the cylinder.

* * * * *